US005657944A

United States Patent [19]

Kewin

[11] Patent Number: 5,657,944

[45] Date of Patent: Aug. 19, 1997

[54] UNWINDING ROLLS OF PAPER

[76] Inventor: Daniel D. Kewin, 16 Dogwood Drive, Brantford, Ontario, Canada, N3R 1R3

[21] Appl. No.: 708,762

[22] Filed: Sep. 5, 1996

[51] Int. Cl.[6] ..... B65H 16/06

[52] U.S. Cl. ..... 242/559.2

[58] Field of Search ..... 242/559, 559.1, 242/559.2, 571.2, 578, 578.2, 598, 598.3, 598.5

[56] References Cited

U.S. PATENT DOCUMENTS

| | | | |
|---|---|---|---|
| 1,501,619 | 7/1924 | Pickell | 242/559.2 |
| 2,130,233 | 9/1938 | Greenwood | 242/559.1 |
| 3,022,022 | 2/1962 | Freeman | 242/559.2 |
| 4,196,866 | 4/1980 | Schaffner et al. | 242/559.2 |
| 4,537,368 | 8/1985 | Radmore et al. | 242/559.2 |
| 5,236,141 | 8/1993 | Kewin | 242/118.31 |
| 5,595,356 | 1/1997 | Kewin | 242/613.5 |
| 5,615,845 | 4/1997 | Kewin | 242/613.5 |

FOREIGN PATENT DOCUMENTS

| | | | |
|---|---|---|---|
| 768013 | 9/1967 | Canada | 242/578.2 |
| 1 121 462 | 1/1962 | Germany | 242/578 |

*Primary Examiner*—John P. Darling
*Attorney, Agent, or Firm*—Rogers & Scott

[57] ABSTRACT

A method of mounting narrower paper rolls for unwinding on a pair of stub chucks spaced for mounting and unwinding full width paper rolls and carried by arms of a pair of multiple reel stands includes providing a narrower paper roll wound on a tubular core assembly having a hollow cylindrical core member and an annular end member of metal or plastic within each opposite end portion of the core member. The end members are removed from the core member, and the core member is mounted at a desired longitudinal location on a full length shaft having opposite ends engageable with the stub chucks. Core member engaging devices are provided to enable the core member to be secured in the desired longitudinal location and to transmit rotational torque from the shaft to the core member. The full length shaft with the narrower paper roll thereon is then mounted on the stub chucks. A narrower paper roll can thus be mounted on multiple reel stands whose stub chucks are spaced for full width paper rolls without interrupting the unwinding operation of another paper roll mounted on the multiple reel stands.

3 Claims, 2 Drawing Sheets

UNWINDING ROLLS OF PAPER

This invention relates to the unwinding of rolls of paper in printing operation in which it is sometimes necessary to use a roll of paper with a narrower width than the normally used full width paper rolls.

BACKGROUND OF THE INVENTION

In a typical printing operation, for example a press room where newspapers are printed, a full width roll of paper (in North American press rooms) typically has a width of 4.5 feet. The paper is wound on a core with a length equal to the width of the paper, i.e. 4.5 feet, the core having an appropriate internal diameter at its ends such that the roll can be mounted on a pair of appropriately spaced stub chucks at an unwinding station. The stub chucks are usually designed for use with a core having an internal diameter of 3 inches at its ends. The stub chucks may be of the kind which have conical portions which are inserted in the ends of the core, with axial pressure then being applied to force the stub chucks into engagement with the ends of the core. Alternatively, the stub chucks may be of the kind which have radially movable portions which can be moved radially outwardly, after insertion of the stub chuck into an end of the core, to engage the interior of the core. It has now become conventional to use a core comprising an elongated tubular core member of helically wound paperboard material with an inner diameter of 3 inches.

Each stub chuck is usually carried on the radially outer end of an arm whose radially inner end is rotatably mounted on an axle carried by a multiple reel stand, there being two multiple reel stands appropriately spaced apart for mounting a full width paper roll therebetween. Each reel stand axle carries at least one other arm with a stub shaft at its radially outer end so that an empty roll can be replaced by a full roll while another roll is being unwound, i.e. used in a printing operation. When the operative roll is substantially used up, the red arms of each reel stand are rotated as a unit to move the used up roll away from the operative position and move a new roll into its place. As is well known in the art, it is usual to provide a suitable mechanism, for automatically connecting the leading end of the paper on the new roll to the paper being unwound from the end of the operating roll while running at the normal operating speed. The used up (butt) roll is then removed and replaced by a new roll while the original new roll is being used. There is thus no interruption in the paper supply to the printing operation.

During printing operations, it is routinely necessary to use paper which is narrower than the usual full width. Such narrow paper is wound on a core of the same kind as but shorter than the core on which full width paper is wound. The usual practice in the printing industry is to shut down the printing operation and re-adjust the spacing of the stub chucks for receiving the shorter core which carries a roll of narrower paper. Such repositioning takes a considerable time, for example about 30 minutes, with the result that there is lost production and idleness of workers in every stage of the printing operation, as well as product waste caused by the usual re-startup problems. Also, especially in the newspaper industry, there is a possibility of missing deadlines for delivery of the newspapers. This problem has been present in the printing industry for many years.

Attempts have been made to provide arrangements which avoid repositioning of the stub chucks, for example by providing a half shaft having one end inserted into an end of the core and the opposite end mounted on one of the stub chucks, the end of the shaft inserted into the core being of lesser external diameter for insertion into the core than the external diameter of the other end which has to receive the stub chuck. This solution is expensive and potentially dangerous to the operators because the half shafts are of solid steel and very heavy for manual movement. Also, with such half shafts, it is not possible to position a narrower paper roll at any desired longitudinal location between the stub chucks. Such positioning capability is essential for optimum printing production.

Consideration has also been given to providing a shaft with a length corresponding to a full width roll, the shaft having opposite ends mountable on normally spaced stub chuck, and on which a narrower paper roll can be mounted. However, this would require the rolls of narrower paper to be mounted on cores with a larger internal diameter than those on which rolls of full width paper are wound in order to receive the shaft. This is not done because it is not practically or economically feasible for paper manufacturers to do so. In a winding operation, all core members must have the same outside diameter to enable paper to be wound simultaneously on side by side cores with different lengths. Also, the cores must have the same inside diameter necessary for mounting on unwind chucks in a printing operation, with there consequently being insufficient inside diameter to receive a full length shaft which could be mounted on unwind chucks in a printing operation.

It is therefore an object of the present invention to provide a satisfactory solution to this problem.

SUMMARY OF THE INVENTION

According to the invention, both full width paper and narrower width paper are wound on tubular core assemblies having a hollow cylindrical core member and an annular end member within each opposite end portion of the core member. Each annular end member has an outer annular surface removably secured to the inner annular surface of the core member and an inner annular surface dimensioned to receive a roll supporting stub chuck.

The paper manufacturer can thus use the same size core member for different paper widths and insert the end members into the ends thereof. When a narrower width roll is required in a printing operation, the end members can be removed and the core member, which will have a larger internal diameter than the internal diameter of the end members, can be mounted on a full length shaft which has opposite ends mountable on the stub chucks. The narrower roll can thus be mounted at any desired location along the length of the full length shaft, with any suitable means being provided to retain the core member in position at the desired location and also to securely engage the core member in such a manner that rotational torque is transmitted from the shaft to the core member.

Thus, a used full width roll on a multiple reel stand can easily be replaced by a narrower width roll or vice versa during a printing operation without the printing operation having to be stopped.

The present invention accordingly provides a method of mounting narrower paper rolls for unwinding on a pair of stub chucks spaced for mounting and unwinding full width paper rolls, the method including providing a narrower paper roll wound on a tubular core assembly having a hollow cylindrical core member of paperboard material and an annular end member of metal or plastic within each opposite end portion of the core member, removing the end members from the core member, mounting the core member at a desired longitudinal location on a full length shaft having opposite ends engageable with said stub chucks and core member engaging devices to enable the core member to be secured in said desired longitudinal location and to transmit rotational torque from the shaft to the core member, and mounting the full length shaft with the narrower paper roll thereon on said stub chucks.

The core member engaging devices may comprise radially movable portions on the full length shaft which are movable radially outwardly to engage the inner surface of the core member to secure the core member at said desired longitudinal location and transmit rotational torque from the shaft to the core member.

Alternatively, each end member may have at least one radially projecting lug, with the core member having at least one lug receiving notch at each end receiving the lug of the respective end member, the core member engaging devices comprising a pair of clamps slidable along the full length shaft and engageable in the notches at opposite ends of core member after the end members have been removed, said clamps being securable to the full length shaft in their core member engaging positions.

The tubular core assembly may for example be as described in my U.S. Pat. No. 5,236,141 issued Aug. 17, 1993, U.S. Pat. No. 5,595,356 issued Jan. 21, 1997, or U.S. Pat. No. 5,615,845 issued Apr. 1, 1997, which describe tubular core assemblies with metal or plastic end members which can be used with the present invention. The contents of said patent and patent applications are hereby incorporated herein by reference.

DESCRIPTION OF THE PREFERRED EMBODIMENTS

Figure 1:
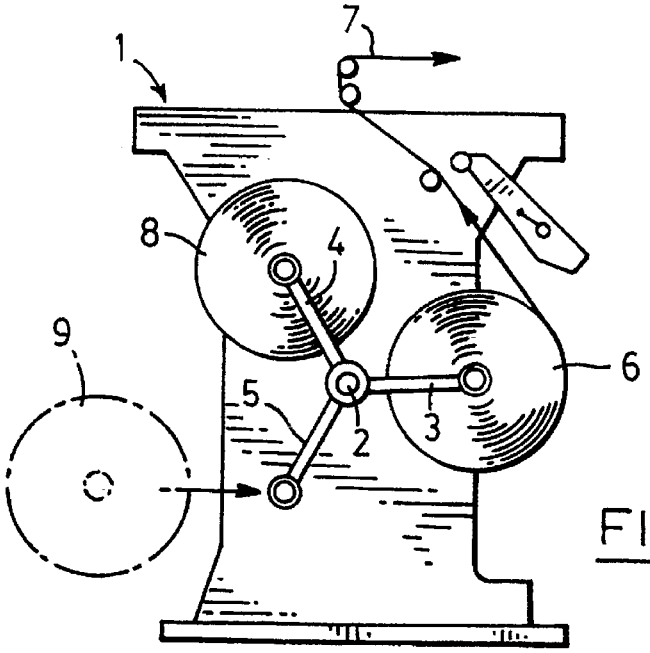
Figure 2:
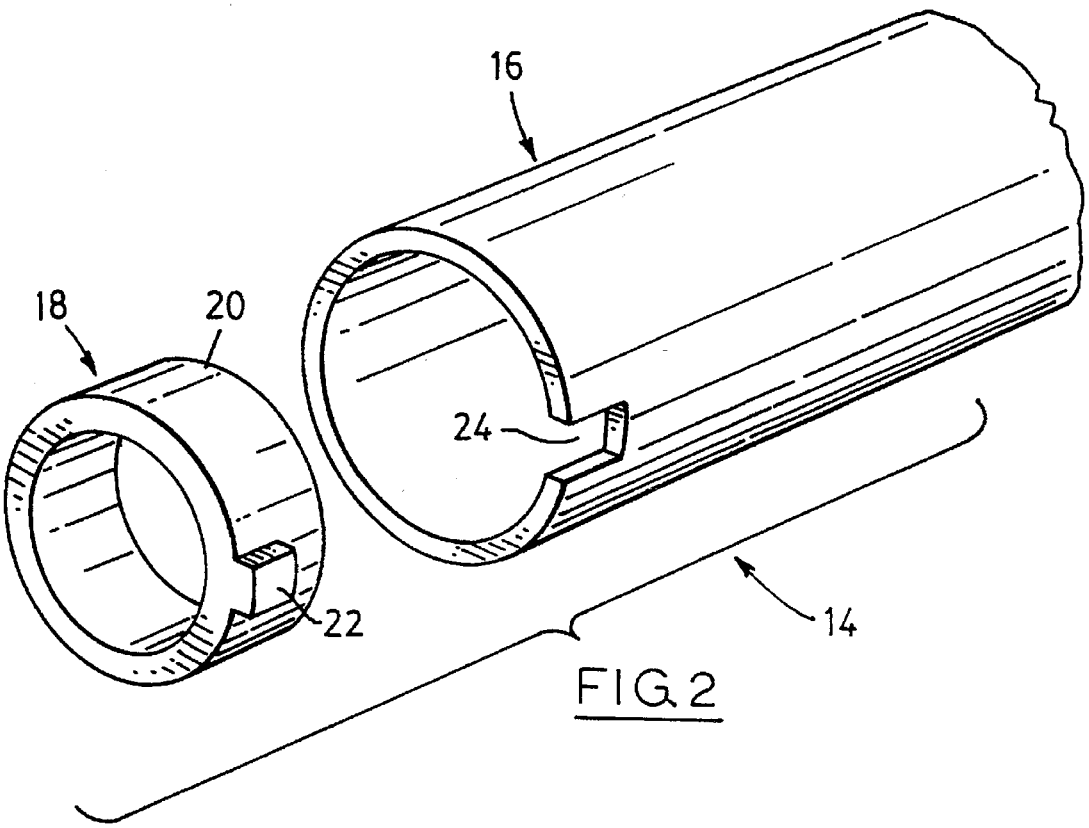
Figure 3:
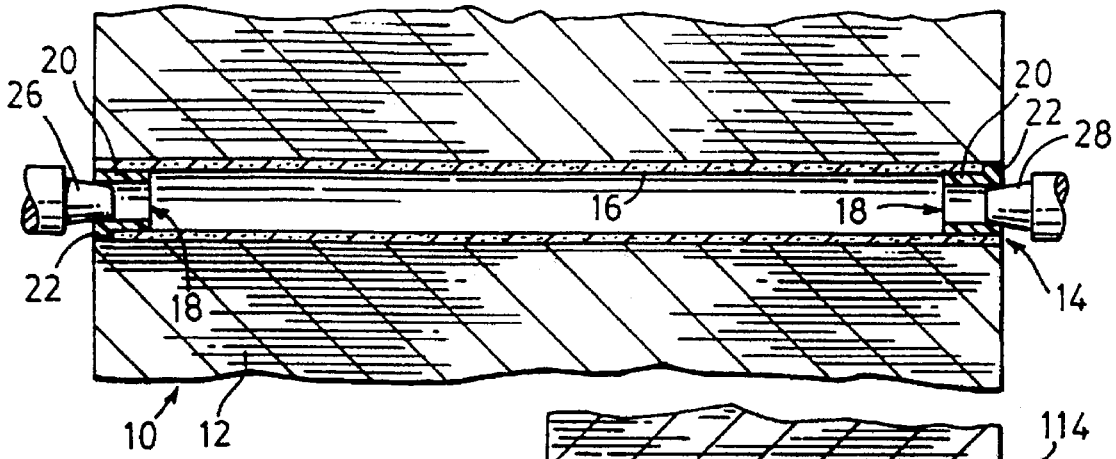
Figure 4:
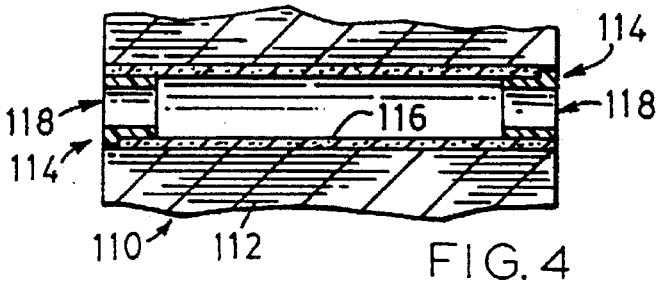
Figure 5:
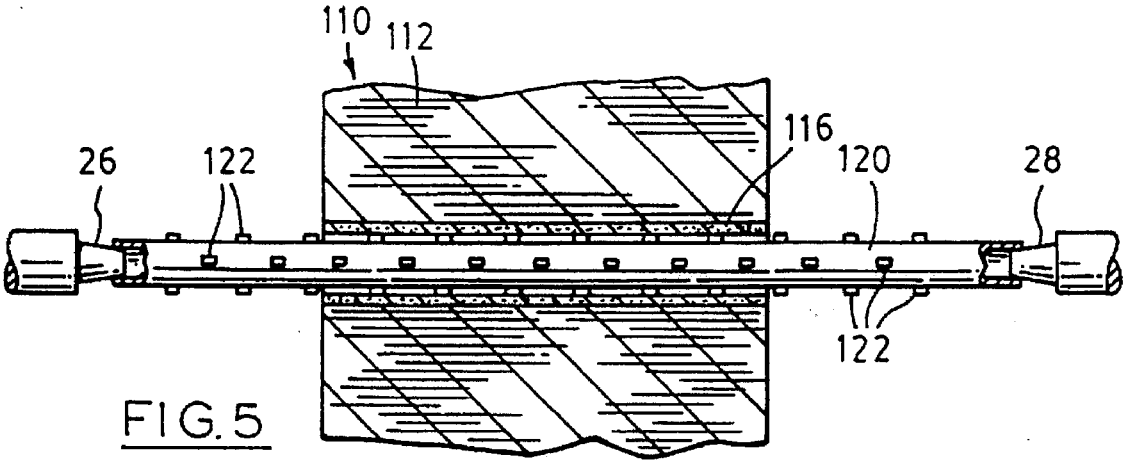
Figure 6:
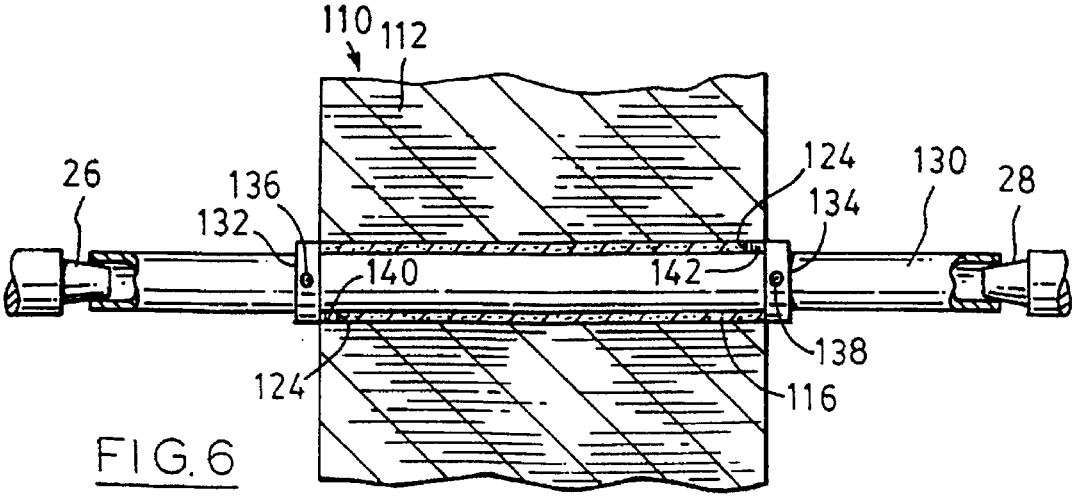

Embodiments of the present invention will now be described, by way of example, with reference to the accompanying drawings, of which:

FIG. 1 is a diagrammatic side view of a multiple roll stand which can carry three paper rolls, FIG. 2 is an exploded view of the tubular core assembly showing an annular end member and an end portion of the core member, FIG. 3 is a sectional side view of a full width paper roll comprising full width paper wound on a tubular core assembly and mounted on a pair of appropriately spaced stub chucks, FIG. 4 is a sectional side view of a half-width paper roll, and FIG. 5 is a similar view of the half-width paper roll of FIG. 4 mounted on a full width shaft which in turn is mounted on the stub chucks, and FIG. 6 is a similar view to FIG. 5 but showing another way of mounting the half-width paper roll on a full width shaft.

Referring to the drawings, FIG. 1 shows a multiple paper roll (reel) stand 1 as used in a press room. The reel stand 1 carries an axle 2 on which 3 spider arms 3, 4, 5 are rotatably mounted as a unit, a stub chuck (not shown in FIG. 1) being provided at the radially outer end of each spider arm 3, 4, 5. It will be understood that two spaced multiple reel stands 1 will be provided in the press room for carrying paper rolls to be used in a printing operation. A paper roll 6 is mounted on the stub chucks carried by one pair of arms 3 in the operative position, with paper 7 being unwound therefrom. A full paper roll 8 is carried by the stub chucks on the arms 4 ready to be moved into the position currently occupied by roll 6 when roll 6 is substantially used up. An empty (butt) roll, i.e. core member and last few turns of paper, has been removed from the stub chuck carried by the arms 5 which await receipt of a new full roll 9.

A full width paper roll 10 comprises full width paper 12 wound on a tubular core assembly 14. The tubular core assembly 14 is substantially as illustrated in FIGS. 6 to 8 of my U.S. Pat. No. 5,236,141 and has a hollow core member 16 of paperboard material with the same length as the width of the paper 12 and an annular end member 18 of synthetic plastic material with a sleeve portion 20 within each opposite end portion of the core member 16. The core member 16 has multiple spirally-wound wraps (i.e. laminated plies) of paperboard material, and the synthetic plastic material may be a suitable polymeric material such as injection molding grade 25% glass filled nylon type 6.

The sleeve portion 20 of each end member 18 has an outer annular surface which is a compression fit, i.e. a friction fit, in a respective end portion of the core member 16. Each end member 18 has a lug 22 of rectangular section projecting radially outwardly from the end of the sleeve portion 20 at the end of the core member 16. The lug 22 is located in a notch 24 of corresponding rectangular section at the end of the core member 16 and facilitates the transmission of radial torque and axial pressure from the end member 18 to the core member 16.

The full width paper roll 10 is mounted on a pair of appropriately spaced stub chucks 26, 28 which engage the end members 18 of the tubular core assembly 14. Although the stub chucks 26, 28 shown are the well known conical type, they may of course be of any other suitable type, for example the well known type with radially movable portions which are movable radially outwardly to engage the internal annular surfaces of the sleeve portions 20 of the end members 18.

FIG. 4 shows a narrower width roll 110 which, in this embodiment, is half the width of the full width roll 10. The half width roll 110 comprises half width paper 112 wound on a tubular core assembly 114 which is identical to the tubular core assembly 14, except that the core member 116 of the tubular core assembly 114 is half the length of the core member 16 of the tubular core assembly 14.

The narrower width rolls will be supplied by a paper manufacturer with the same type of tubular core assembly as the full width roll because the narrower width rolls wound simultaneously with full width rolls by the paper manufacturer. The present invention is applicable when it is desired to use a narrower width roll, such as the half width roll 110, in a printing operation set up for full width rolls such as the rolls 10.

With the present invention, it is not necessary to change the spacing of the stub chucks 26, 28 or to use half-shafts as in the past. It is simply necessary to remove the end members 118 from the ends of the core members 116, and to slide a full length tubular shaft through the core member 116. The full length shaft has an external diameter which is a sliding fit in the core member 116, and an internal diameter equal to the internal diameter of the end members 118 so that the ends of the full length shaft 120 can fit on the stub chucks 26, 28 as shown in FIG. 5. The full length shaft 120 may be made of any suitable material, such as light steel, aluminum or carbon fibre which provides optimum lightness and strength.

In the embodiment shown in FIG. 5, the full width shaft 120 carries radially movable portions 122 spaced along its length and around its circumference, the radially expandable portions 122 being operable hydraulically or pneumatically in any suitable manner to expand radially into engagement with the interior of the core member 116 and secure the core member 116 to the shaft 120 both axially and angularly.

Thus, an empty full width roll can easily be replaced by a narrower width roll or vice versa during the printing operation without the printing operation having to be stopped.

In the embodiment of FIG. 6, the full length shaft 130 carries two annular clamps 132, 134 which, in their released condition, are slidable along the shaft 130. The clamps 132, 134 are mounted at opposite ends of the tubular core member 116. Each clamp 132, 134 has a retaining screw 136, 138 respectively engageable with the shaft 130 to retain the clamp in position of the shaft 130. Each clamp 132, 134 also has a lug 140, 142 respectively engageable in the notch 124 at opposite ends of the core member 116. Again, the narrower width roll 110 can thus be positioned at any desired location along the length of the shaft 130 during the printing operation without the printing operation having to be stopped.

The advantages of the invention will thus be readily apparent from the foregoing description of a preferred embodiment. Other embodiments will also be readily apparent to a person skilled in the art, the scope of the invention being defined in the appended claims.

I claim:

1. A method of mounting narrower paper rolls for unwinding on a pair of stub chucks spaced for mounting and unwinding full width paper rolls and carried by arms of a pair of multiple reel stands, said method including:

providing a narrower paper roll wound on a tubular core assembly having a hollow cylindrical core member and an annular end member of metal or plastic within each opposite end portion of the core member, removing the end members from the core member, mounting the core member at a desired longitudinal location on a full length shaft having opposite ends engageable with said stub chucks and core member engaging devices to enable the core member to be secured in said desired longitudinal location and to transmit rotational torque from the shaft to the core member, and mounting the full length shaft with the narrower paper roll thereon on said stub chucks, whereby a narrower paper roll can be mounted on multiple reel stands whose stub chucks are spaced for full width paper rolls without interrupting the unwinding operation of another paper roll mounted on the multiple reel stands.

2. A method according to claim 1 wherein the core member engaging devices comprise radially movable portions on the full length shaft which are movable radially outwardly to engage the inner surface of the core member to secure the core member at said desired longitudinal location and transmit rotational torque from the shaft to the core member.

3. A method according to claim 1 wherein each end member has at least one radially projecting lug and the core member has at least one lug receiving notch at each end receiving the lug of the respective end member, and said core member engaging devices comprise a pair of clamps slidable along the full length shaft and engageable in the notches at opposite ends of the core member after the end members have been removed, said clamps being securable to the full length shaft in their core member engaging positions.

* * * * *